United States Patent [19]

Uchida et al.

[11] Patent Number: 4,806,962

[45] Date of Patent: Feb. 21, 1989

[54] AUTOMATIC DEVELOPING APPARATUS

[75] Inventors: Makoto Uchida, Hachioji; Hiroyuki Kakuhari, Hino; Wataru Isogawa; Tadashi Amano, both of Hachioji, all of Japan

[73] Assignee: Konishiroku Photo Industry Co., Ltd., Tokyo, Japan

[21] Appl. No.: 122,535

[22] Filed: Nov. 12, 1987

Related U.S. Application Data

[63] Continuation of Ser. No. 715,534, Mar. 25, 1985, abandoned.

[30] Foreign Application Priority Data

| | | | |
|---|---|---|---|
| Mar. 27, 1984 | [JP] | Japan | 59-42751[U] |
| Mar. 27, 1984 | [JP] | Japan | 59-42752[U] |
| Jun. 1, 1984 | [JP] | Japan | 59-80513[U] |
| Jun. 13, 1984 | [JP] | Japan | 59-88672[U] |

[51] Int. Cl.[4] ..... G03D 3/06

[52] U.S. Cl. ..... 354/324; 354/321

[58] Field of Search ..... 354/298, 319, 320, 321, 354/322, 324, 325

[56] References Cited

U.S. PATENT DOCUMENTS

| | | | |
|---|---|---|---|
| 3,620,725 | 11/1971 | Kosta | 354/322 |
| 3,747,499 | 7/1973 | Foster | 354/322 |
| 3,774,521 | 11/1973 | Beck | 354/324 |
| 3,890,629 | 6/1975 | Huss | 354/323 |
| 3,978,506 | 8/1976 | Geyken et al. | 354/324 |
| 3,990,088 | 11/1976 | Takita | 354/324 |
| 4,021,832 | 5/1977 | Krehbiel et al. | 354/298 |
| 4,171,716 | 10/1979 | Szabo | 354/324 |
| 4,329,042 | 5/1982 | Libicky et al. | 354/324 |
| 4,345,831 | 8/1982 | Kachelries | 354/324 |
| 4,451,132 | 5/1984 | Kishimoto | 354/324 |
| 4,533,225 | 8/1985 | Shiga | 354/324 |

FOREIGN PATENT DOCUMENTS

| | | | |
|---|---|---|---|
| 57-90438 | 6/1982 | Japan . | |
| 57-96446 | 6/1982 | Japan . | |
| 1296037 | 11/1972 | United Kingdom | 354/324 |
| 1360942 | 7/1974 | United Kingdom | 354/322 |

*Primary Examiner*—A. A. Mathews

*Attorney, Agent, or Firm*—Jordan B. Bierman

[57] ABSTRACT

An automatic developing apparatus for developing photosensitive materials, wherein a water supply tank for storing water used to dilute or dissolve processing agents and a waste fluid tank for storing waste fluids after the processes thereof are housed therein. The waste fluid tank is removably incorporated in the apparatus.

16 Claims, 4 Drawing Sheets

AUTOMATIC DEVELOPING APPARATUS

This application is a Continuation, of application Ser. No. 715,534, filed Mar. 25, 1985, now abandoned.

BACKGROUND OF THE INVENTION

1. Field of the Invention

The present invention relates to an automatic developing apparatus for photosensitive materials, and more particularly to a compact automatic developing apparatus which needs no utility piping.

2. Description of the Prior Art

In general, photographic paper which has been exposed by a printer is transferred to an automatic developing apparatus in a magazine containing the photographic paper loaded into an attachment portion thereof, and is then subjected to various processes such as developing, bleaching, fixing, washing, drying, etc., to obtain the final prints.

However, this processing method requires water for dissolving the processing agents. To supply this water, a water supply tank is installed, and water is supplied to the tank from the outside through, for example, the water mains (refer to Japanese Utility Model Laid-Open No. 90438/1982 and No. 96446/198), whereas waste water is discharged directly from the processing tank to a waste water tank through piping.

However, the provision of utility piping such as a water main and the discharge piping for the waste water is disadvantageous in that it increases the cost of the piping. In addition, this type of automatic developing apparatus can not be installed where there is no mains water supply, and, once it is installed, is difficult to move, so that it is not suitable for demonstration use.

In order to develop exposed photographic materials such as photographic film or photographic paper, for example, the photosensitive materials are generally fed in succession into an automatic developing apparatus through an inlet thereof, are processed as they pass through a series of developing, fixing, stabilizing, washing, etc., tanks which are usually arrayed in a line, and then dried to obtain the completed prints. The processing solutions used in these processes, such as the developing solution, fixing or bleaching/fixing solution, stabilizing solution, etc., become fatigued and their capabilities decrease as the quantity of processed photosensitive materials increases, so fresh replenishing solutions must be supplied as required.

Conventionally, these replenishing solutions are usually introduced into the developing apparatus through pipes from replenishment tanks provided outside the apparatus.

The developing apparatus also requires a number of pipes used to take in water for washing, and also discharge the waste washing water as well as waste processing solutions, in addition to the pipes for introducing the replenishing solutions, and hence large-scale construction work is required at installation. An improved apparatus has been developed as a compact developing apparatus which is free of these disadvantages and which can easily be installed in any desirous place, in which the developed photosensitive materials are rinsed with a rinsing solution containing components which are effective for stabilizing these materials, instead of washing with running water, and each waste solution is stored in a waste solution tank housed in the developing apparatus, thereby eliminating the need for piping providing connection with the outside.

Replenishing solutions for the processing agents, such as developing solution, fixing solution, etc., must be prepared in batches of a certain quantity by dissolving kits of chemicals or by diluting condensed solutions, In the above compact automatic developing apparatus, it is usual to prepare each replenishing solution in a separate container, and then store it in a tank installed outside the developing apparatus, or transfer it to a replenishment tank housed within the development apparatus, to replenish it as required However, this raises several problems concerning inconvenience of operation and the need of additional space for preparing the solutions where the developing apparatus is installed, so there is still room for improvement.

In a color photographic laboratory, a color negative film (negative photographic material) is developed to form a negative image which is exposed on color paper so that a positive image is printed onto the color paper (positive photographic material) in accordance with the negative image.

This color photographic developing process requires at least one each of an automatic developing apparatus for negative photographic materials and an automatic developing apparatus for positive photographic materials.

In order to process photosensitive materials by an automatic developing apparatus while supplying replenishing processing solutions (hereinafter referred to simply as replenishing solutions), two types of processing solutions are usually employed; a starting processing solution (hereinafter referred to simply as starting solution) and a replenishing solution.

The automatic developing apparatus carries out the developing process automatically in such a manner that photographic film or paper with latent images thereon are passed through a series of processing tanks, each filled with the appropriate starting solution, by a feeding rack. During this time, the replenishing solutions are supplied to the processing tanks in such a manner that a certain quantity of each replenishing solution is supplied intermittently so that the processing solution overflows from the processing tank, or a certain quantity of replenishing solution is supplied continuously thereto.

Each starting solution and replenishing solution are prepared by dissolving or diluting a kit of processing agent with water. An automatic developing apparatus for photographs generally includes a washing tank and hence also needs mains supply piping for the washing.

In recent years, some areas in Japan undergo water shortages every few years which leads to restrictions in water supply. In these areas, it is permitted to employ a large quantity of water for an automatic developing apparatus when there is a shortage of drinking and washing water. As well as these seasonal water shortages, there are many areas around the world, such as in desert zones, where water is very valuable and it is extremely difficult to use much water for an automatic developing apparatus. Thus there is a demand for the development of an automatic developing apparatus which employs as little water as possible.

A conventional automatic developing apparatus usually requires a large working space around itself, which is used for work such as the adjustment of replenishing cocks, correction of evaporation, exchange of processing solutions, dissolving of replenishing solutions, etc. The presence of water piping on the ground in this space where this work is carried out is dangerous, and undesirable from the standpoint of the working environment. In addition, an automatic developing apparatus always requires construction work for the water piping when newly installed it or relocating it later, and hence also requires the time and cost of such construction work.

For this reason, an automatic developing apparatus can be contemplated as a non-washing type which has neither a washing tank nor mains water piping for washing, and which includes replenishing solution feeding tanks for automatically supplying processing solutions used to process photosensitive materials, a water supply tank housed therein for storing water used to dilute or dissolve processing agents, and a waste fluid tank detachably incorporated therein for storing waste fluids after the processes. Because it is a non-washing type with no washing tank and a built-in waste fluid tank, this apparatus can be put into service without the need of utility supply means such as water piping and discharge piping means for the waste fluids. The elimination of piping leads to a reduction in the construction costs for piping and makes the size of the entire apparatus more compact, and the resultant apparatus is also suitable for demonstration or other uses in which no water supply is available. The applicants of this application has succeeded in omitting even the water mains piping for cooling, as disclosed in Japanese Patent application No. 69157/1984 and No. 71837/1984.

As a result of continued study into an automatic developing apparatus which has no washing or piping, and which includes replenishing solution supply tanks housed therein, the inventors have found that, when conducting the maintenance of the various processing tanks and internal piping, the replenishing solution supply tanks housed in the apparatus are obstructive, and hence make the maintenance work very difficult. In particular, if such an automatic developing apparatus is installed in a small space, e.g., in a small color photographic developing laboratory, it can be foreseen that the maintenance work will become more difficult.

SUMMARY OF THE INVENTION

An object of the present invention is to provide an automatic developing apparatus which can be operated even in places without utility supply means such as mains water piping or means for discharging waste fluids to the exterior.

Another of the present invention is to provide an automatic developing apparatus which can be constructed to have a compact form.

Still another object of the present invention is to provide an automatic developing apparatus which is suitable for demonstration use, and which is particularly suitable for processing photographic paper.

As a result of concentrated studies, the inventors have found that these objects can be achieved by an automatic developing apparatus which includes means adapted to develop photosensitive materials, and which is characterized by comprising an inlet through which the photosensitive materials are inserted, replenishing tanks for automatically supplying processing solutions used to process the photosensitive materials, a water supply tank housed therein for storing water used to dilute or dissolve processing agents, and a waste fluid tank detachably incorporated therein for storing waste fluids after the processes.

A further object of the present invention is to provide a compact automatic developing apparatus which requires no exterior preparation containers, replenishing tanks, etc., for supplying replenishing solutions of processing agents.

This object has been achieved by an automatic developing apparatus for photosensitive materials which includes a plurality of processing tanks arranged in line, characterized in that a plurality of preparation tanks for preparing and storing replenishing solutions to be supplied to the corresponding processing tanks are arranged inside the body of the automatic developing apparatus, parallel to the line of processing tanks.

In other words, preparation tanks are provided within the automatic developing apparatus parallel to the processing tanks, and each replenishing solution is prepared and stored in its preparation tank and thereafter supplied to the adjacent processing tank as required.

The preparation tanks may be provided with mixing means adapted to mix and dissolve the chemicals as required. It is preferable to install mixing means in the preparation tanks for replenishing solutions which handle chemicals which are difficult to dissolve.

Any known means for recirculating a fluid, as the mixing means, can be employed such as a pump, stirrer, etc., which is usually used for mixing liquids.

The preparation of each processing solution in its preparation tank can be performed by first pouring a certain amount of water into the tank, adding an undiluted solution of the processing agent, and then mixing them by agitation. For a difficult-to-dissolve processing agent, such as a color developing solution, it is possible to dissolve the agent by agitation using a stirring pump or the like.

Water can be supplied from a water supply tank which is installed separately inside the apparatus.

A still further object of the present invention is to simplify the maintenance of the various processing tanks and/or replenishing solution supply tanks, or internal piping, etc., in the automatic development apparatus which has the resupply feeding tanks housed therein.

To achieve this object, a replenishing solution supply tank assembly in an automatic developing apparatus according to the present invention, in which photosensitive materials are automatically developed while supplying replenishing processing solutions from the replenishing solution supply tanks to starting solutions filling the processing tanks, is characterized in that the automatic developing apparatus is a non-washing type which has no washing tank, and is also a non-piping type which has no mains water piping for washing, and at least one of the replenishing solution supply tanks housed in the automatic developing apparatus can be moved out of the automatic developing apparatus to be exposed to the outside.

These and other objects and features of the present invention will be described hereinafter with reference to the accompanying drawings.

BRIEF DESCRIPTION OF THE DRAWINGS

FIGS. 1 to 4 illustrate one embodiment of an automatic developing apparatus in accordance with the present invention, in which:

FIG. 1 is a schematic plan view of the apparatus with a cover thereof removed;

FIG. 2 is a section taken along the line II—II of FIG. 1;

FIG. 3 is a section taken along the line III—III of FIG. 1; and

FIG. 4 is a section taken along the line IV—IV of FIG. 1;

DESCRIPTION OF THE PREFERRED EMBODIMENTS

Figure 1:
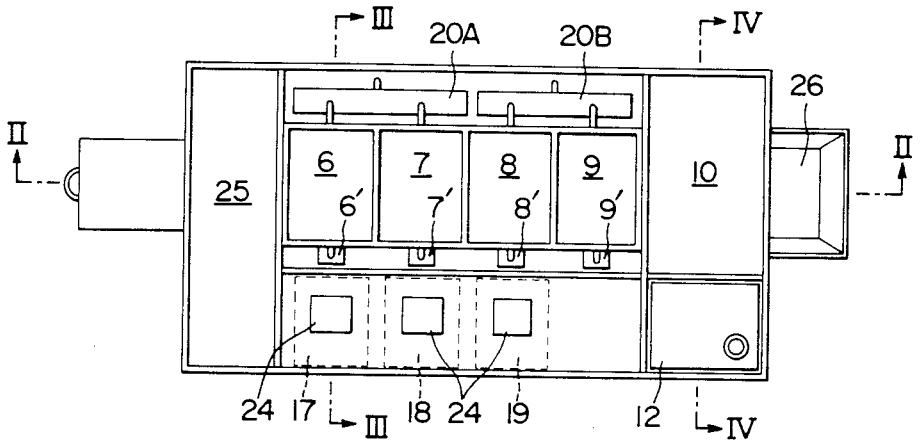
Figure 2:
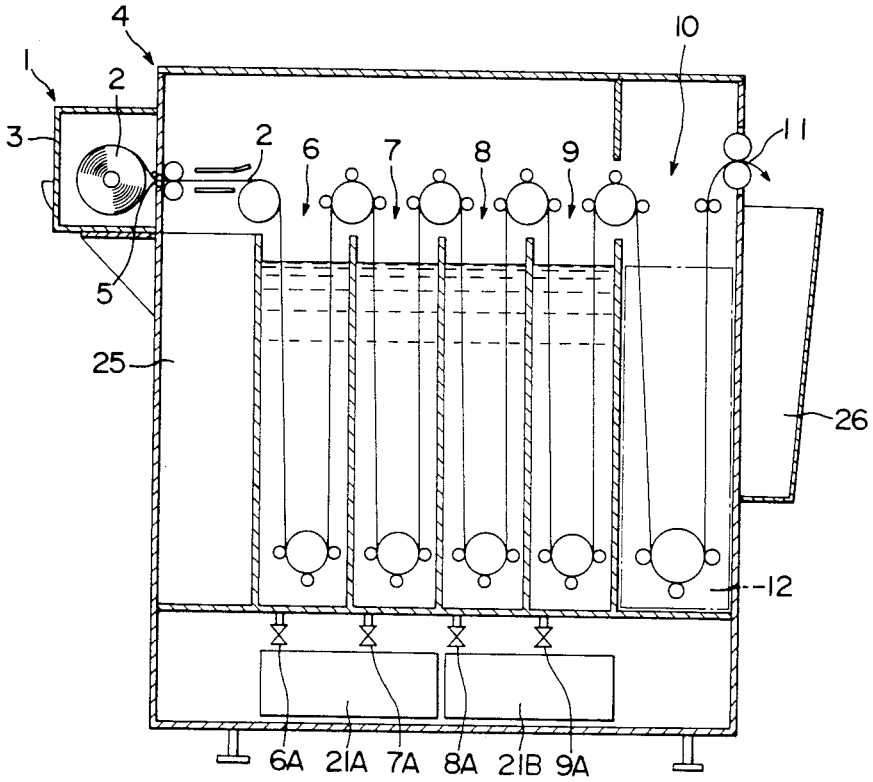

Referring first to FIGS. 1–4, reference numeral 1 denotes an attachment portion into which is loaded a magazine 3 containing photographic paper 2 which has been exposed by a printer (not shown) so that it has latent images thereon, the attachment portion 1 being provided on one side wall of a body 4 of an automatic developing apparatus.

The photographic paper 2 loaded into the attachment portion 1 enters the body 4 through a body inlet 5, and is automatically processed by a developing tank 6, a bleaching/fixing tank 7, a first rinsing tank 8, and a second rinsing tank 9. It is then dried in a drying portion 10 (which has an openable cover), is removed from a body outlet 11, and is thereafter finished by cutting and other steps to provide prints.

The developing tank 6, bleaching/fixing tank 7, first rinsing tank 8, and second rinsing tank 9 are arranged in succession in a line, as shown in the figures. Each of these tanks is provided with rollers for feeding on the photographic paper, so that each predetermined process is carried out while the photographic paper 2 is immersed in the appropriate solution. The tanks 6–9 are each provided with openable covers.

Figure 4:
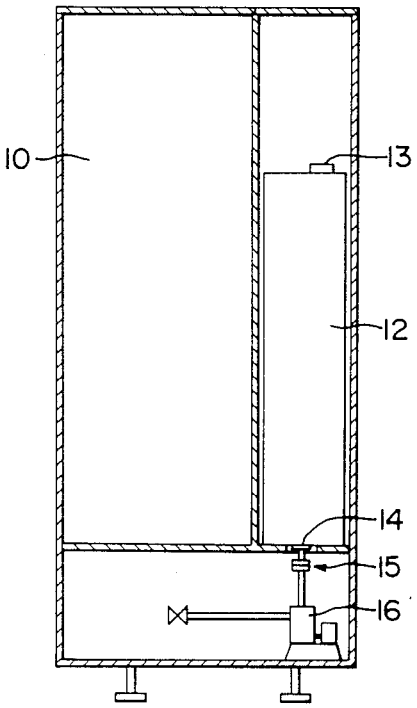

As can be seen from the figures, the drying portion 10 is positioned at one side of the second rinsing tank 9, while a tank 12 for supplying water used to dilute or dissolve the processing agents is detachably provided at one side of the drying portion 10. FIG. 4 illustrates the state in which the tank 12 is attached. Tha tank 12 has a water inlet port 13 at the top thereof and a water outlet port 14 at the bottom thereof. The water outlet port 14 is connected to a drawing pump 16 by, for example, a joint or coupling 15. It must be noted that, although in this embodiment the tank 12 can be removed after opening the top cover of the body 4, the invention is not limited to such an arrangement.

Reference numerals 17, 18, and 19 denote a developing solution replenishing tank, a bleaching/fixing solution replenishing tank and a rinsing solution replenishment tank (common to both the first and second rinsing tanks), respectively, which are formed on one side of the corresponding developing tank 6, bleaching/fixing tank 7, and first rinsing tank 8. The replenishing tanks 17, 18, and 19 are used to supply the processing solutions to the corresponding tanks 6, 7, 8, and 9, when those solutions become fatigued.

The processing tanks 6, 7, 8 and 9 are each provided at intermediate portions thereof with filters 6', 7', 8', and 9', respectively, for cleaning the solutions which are circulated by pumps.

Figure 3:
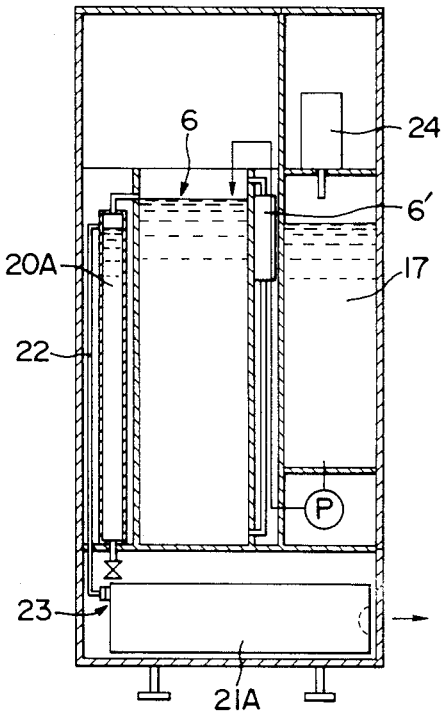

When the solutions are supplied from the replenishing tanks 17, 18, and 19, waste fluids corresponding to the supplied solutions overflow and are stored in auxiliary waste fluid tanks 20A, 20B. When the tanks 20A, 20B are full, the waste fluids overflow therefrom and are stored in waste fluid tanks 21A, 21B. These waste fluid tanks 21A, 21B are polyethylene containers, for example, which are provided in a removable manner. FIG. 3 illustrates the state in which the waste fluid tanks 21A, 21B are mounted, and the tanks are connected to overflow pipes 22 of the auxiliary waste fluid tanks 20A, 20B by joints or couplings 23, for example. When removing the waste fluid tanks, it is only necessary to pull them out in the direction of the arrow, after disconnecting the joints 23.

The auxiliary waste fluid tanks 20A, 20B can be dispensed with so that the overflown waste fluids are introduced directly into the waste fluid tanks 21A, 21B and housed therein. This can make the apparatus more compact.

The waste fluids can be stored in the waste fluid tanks 21A, 21B in such a manner that the waste developing solution is stored in one tank 21A, for example, while other waste fluids are stored in the other tank 21B, thereby facilitating the recovery of silver. Alternatively, they can be stored without such separation.

It is preferable that the waste fluid tanks 21A, 21B have a volume sufficient to enable the removal of the stored waste fluids about once a week, when the automatic developing apparatus is operated every day. However, no specific limitation is imposed on the volume of these tanks. The waste fluid tanks 21A, 21B can also be provided with some type of sensor and an alarm or indicator which are able to detect the fluid level and issue an alarm or indication in combination thereof when each tank is filled with a predetermined amount of waste fluid.

Undiluted replenishing solutions are supplied to the respective replenishing tanks 17, 18, and 19 from replenishing kits 24, and water is supplied to those replenishing tanks from the water supply tank 12 by a pump 16 and is mixed therein, to prepare the desired processing solutions. The replenishing solutions thus prepared are introduced into the corresponding replenishing tanks 17, 18, and 19 through supply ports 6A, 7A, and 8A, 9A (or other suitable supply ports), respectively, by pumps (not shown).

In the figures, 25 denotes a control system box and 26 a box for collecting the processed photographs. The bleaching/fixing process in the foregoing embodiment can be modified to provide a two-bath process of bleaching and fixing which are separated from each other. Each process is not necessarily of the bath or tank type; it can be of a spray or other suitable type. The foregoing developing process is described by way of one example thereof, but it can be modified to provide any other desired process.

Although photographic paper is used as the sensitive material in the above case, it is obvious that negative film or any other type of sensitive material can be used instead, and that two or more series of processing tanks can be provided in parallel.

According to the above embodiment of the present invention, since the water supply tank and the waste fluid tanks are all housed within the automatic developing apparatus, the apparatus can be put into service without the need of utility supply means such as water pipes and discharge piping means for the waste fluids. The elimination of these piping means leads to a reduction in the construction cost of the piping, and makes the entire apparatus more compact, thus contributing to the effective use of space. In addition, the resultant apparatus is also suitable for demonstration or other purpose where a water supply is not available.

Figure 5:
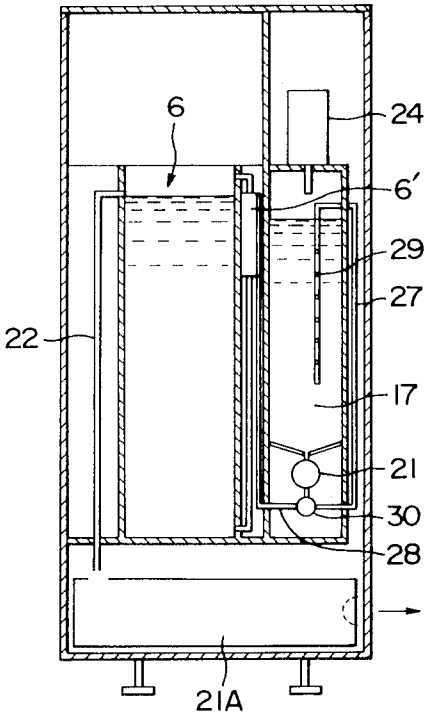
FIG. 5 is a section similar to that taken along the line III—III of FIG. 1 of another embodiment of the present invention.

According to another embodiment of the present invention, shown in FIG. 5, the preparation tank 17 for preparing the developing solution is provided with means for recirculating and agitating the solution. More specifically, 21 denotes a feed pump and at 30 a three-way valve. During preparation, the three-way valve 0 is set in such a position that the pump 21 can be connected to a pipe 27. When the feed pump 21 is started after a certain amount of water is poured into the tank 17 and undiluted solution is added thereto from an undiluted replenishing solution kit 24, the solution in the tank 17 is drawn from the bottom thereof to rise through the pipe 27, and is then injected through a plurality of small holes 29 therein which are open to the solution, so that the undiluted solution is dissolved as it circulates. After preparation, the position of the threeway valve 30 is reversed so that the pump 21 is connected to a developing solution replenishing pipe 28 communicating with the developing tank 6. After that, the feed pump 21 is operated to supply the developing solution on demand.

The remaining tanks 18, 19 which do not require any special agitation means, are provided with only feed pumps and processing solution replenishing pipes for supplying the processing solutions. It is sufficient if the agitation of the solutions in these tanks during preparation is done manually two or three times, using a rod-like stirrer. If agitation is specifically required for preparing a solution, depending on the composition of the processing agent, a similar agitation means to that provided for the developing solution preparation tank 17 can be provided instead.

According to this embodiment of the present invention, the replenishing solutions can be prepared in corresponding preparation tanks housed in the automatic developing apparatus, and hence there is no need to prepare the solutions outside the apparatus, so that it is possible to install and operate the apparatus without being bound by restrictions concerning the installation place, surrounding conditions, etc.

Figure 6:
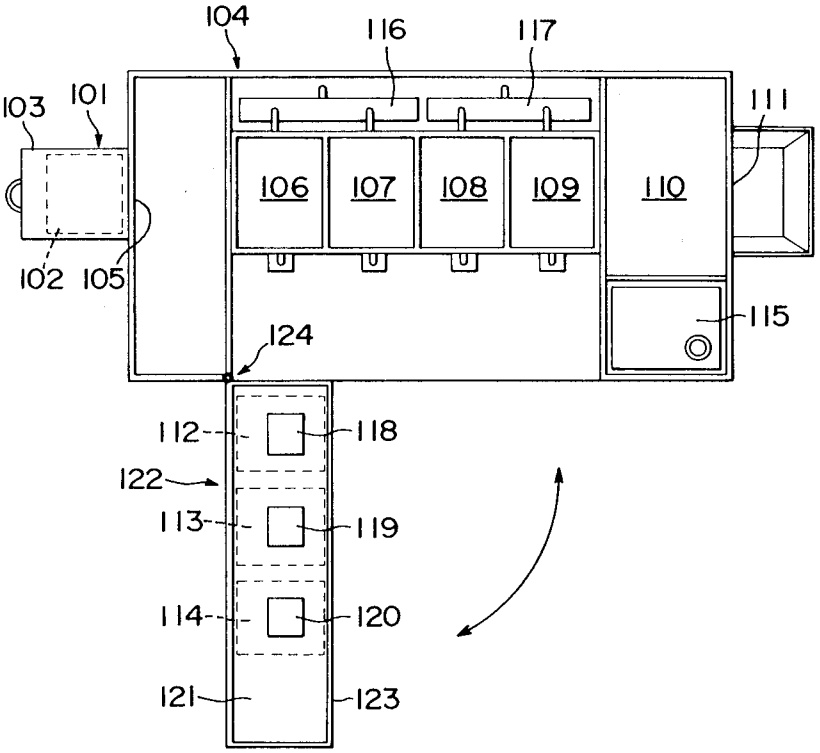
FIG. 6 is a schematic plan view of still another embodiment of the present invention.
Figure 7:
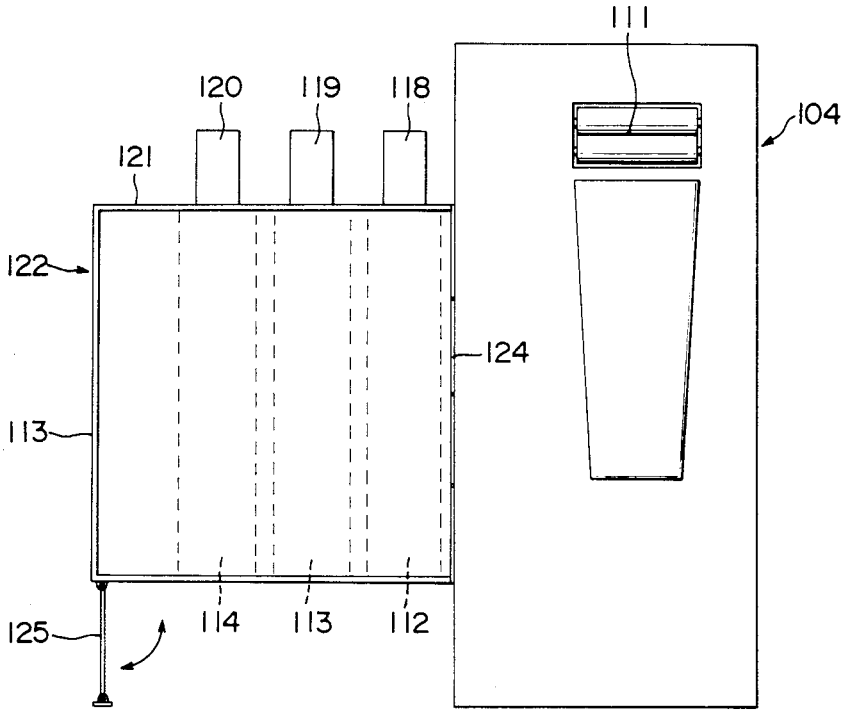
FIG. 7 is a side view of FIG. 6.
Figure 8:
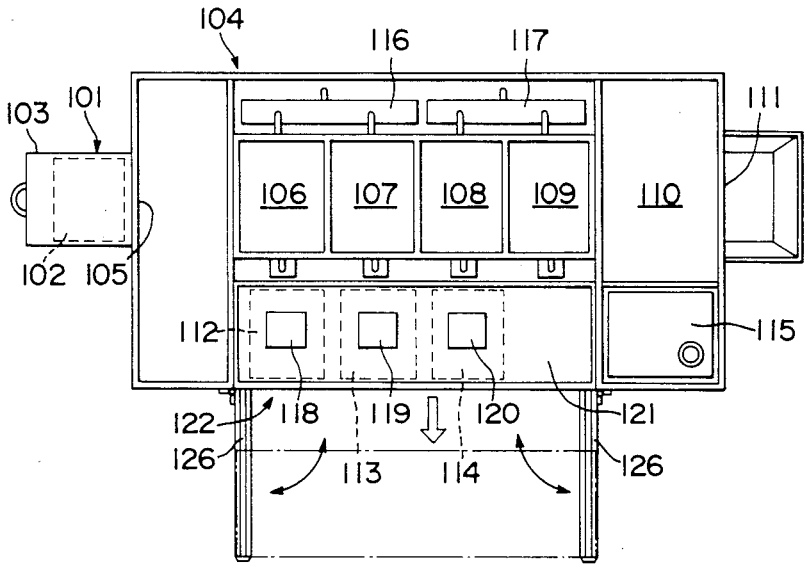
FIG. 8 is a schematic plan view of a further embodiment of the present invention.

FIG. 6 is a schematic plan view of a further embodiment of the present invention, FIG. 7 is a side view of FIG. 6, and FIG. 8 is a schematic plan view of an another embodiment of the present invention.

Photographic paper 102 within a magazine 103 loaded into an attachment portion 101 enters a body 104 through a body inlet 105, and is automatically processed by a developing tank 106, a bleaching/fixing tank 107, a first rinsing tank 108, and a second rinsing tank 109. It is then dried in a drying portion 110, removed from a body outlet 111, and is thereafter finished to produce prints by cutting and other steps, for example, above the body 104.

The developing tank 106, bleaching/fixing tank 107, first rinsing tank 108, and second rinsing tank 109 are arranged in sequence in a line, as shown in the figure. Each of these tanks is provided with rollers for feeding on the photographic paper, so that each predetermined process is carried out while the photographic paper 102 is immersed in the appropriate solution. The apparatus also includes replenishing solution supply tanks 112, 113, and 114 for automatically replenishing the processing solutions used to process the photosensitive materials, a water supply tank 115 (which can be omitted) housed therein in kit-form for storing water used to dilute or dissolve the processing agents, and waste fluid tanks (not shown, but locating under processing tanks 106–109 and the replenishing solution supply tanks 112–114), and/or auxiliary tanks 116, 117 (which can be omitted) removably housed therein for storing the waste fluids after the processes. Reference numerals 118, 119, 120 denote replenishing agent kits, and 121 denotes an openable cover which also acts as a rack on which the kits 118, 119 and 120 are placed.

In this embodiment, a replenishing solution supply section 122 consisted of the replenishing solution supply tanks 112, 113, and 114 as well as the replenishing agent kits 118, 119, and 120 is normally housed in the body 104 but can be removed from the body 104 to the outside, if required.

More specifically, as shown in FIG. 6, the replenishing solution supply section 122 is fixed to a support frame 123 and is pivotally supported on the body 104 so that it can rotate as indicated by the arrow with either the left or right ends of the support frame 123, e.g., the left end in the figure, acting as a pivot 124. With this arrangement, the replenishing solution supply section 122 can be rotated to the front of the body 104 about the pivot 124 acting as a fulcrum, so that it can be removed from the body 104. In order to support the replenishing solution supply section 122 when it has been moved out of the body 104, the replenishing solution supply section 122 is preferably provided with a foldable support member 125, as shown in FIG. 7. The support member 125 is preferably provided with casters.

The support member 125 is not limited to that illustrated. As an alternative, the replenishing solution supply section 122 can be supported by rails or the like which are foldably attached to the body 104 so as to support and guide the upper or lower ends of the section 122.

According to a still further embodiment of the present invention, not shown, unlike the single swing type of the above embodiment, the replenishing solution supply section 122 is arranged as a double-leafed hinged structure so that the section 122 is pivoted to the body 104 with both the left and right ends thereof acting as pivots, and is divided into two parts at an appropriate position, preferably at substantially the center, so that the divided parts of the section 122 can be rotated to the front of the body 104 about the left and right pivots. When embodying this arrangement, it is necessary to consider how to prevent the replenishing solution supply tanks 112, 113, and 114 striking each other at the divided surfaces of the replenishing solution supply section 122, when it is moved out of or into the body 104. In this embodiment, the replenishing solution supply section 122 is also preferably provided with a support member, similar to that of the previous embodiment.

FIG. 8 illustrates a yet further embodiment in which at least one guide rail 126 or the like, which is adapted to guide and support the upper or lower side of the support frame 123 fixing the replenishing solution supply section 122, is attached to the body 104 in a foldable manner, so that the replenishing solution supply section 122 can be slid to the front of the body 104 while being guided at the upper or lower side thereof by the guide rail(s) 126. In this case, a support member (preferably including casters) can also be provided, in the same way as in the previous embodiments.

Although in the above embodiments the replenishing solution supply tanks 112, 113, and 114 are arranged so that they can be moved out of or into the body 104 together in a unit of two or more tanks, the embodiments can be applied to each of the replenishing solution supply tanks 112, 113, and 114 separately. Furthermore, although the replenishing solution supply section 122 is described in the above embodiments to be movable together with the replenishing agent kits 118, 119, and 120, the kits 118, 119, and 120 can be omitted.

The previously-described technical objects can be achieved by the foregoing embodiments. In other words, when conducting the maintenance of each of the processing tanks and/or replenishing solution supply tanks or the internal piping, etc., the replenishing solution supply tanks can easily be moved by a rotational or sliding movement as they are. As a result, maintenance can be conducted with ease.

What is claimed is:

1. An apparatus for processing photosensitive material having a plurality of elements including processing tanks and a drying portion, said processing tanks comprising a developing tank; a bleaching tank and a fixing tank, or a bleach/fix tank; and a rinsing tank; there being a replenishing tank for each of said processing tanks on one side of its corresponding processing tank, a space on the same side of said drying portion as said replenishing tanks, a water supply tank in said space, said water supply tank holding water for dilution and/or dissolving solutions used for processing said material.

2. The apparatus of claim 1 wherein said water supply tank is removable from said space.

3. The apparatus of claim 1 wherein said replenishing tank corresponding to said developing tank comprises a circulating means.

4. The apparatus of claim 3 wherein said circulating means comprises a feed pump having its melt connected to said developing tank at a first point, a pipe from an outlet of said pump extending into said developing tank at a second point remote from said first point, whereby actuation of said pump causes solution in said developing tank to be recirculated.

5. The apparatus of claim 3 wherein said circulating means comprises a feed pump having its inlet connected to said replenishing tank corresponding to said developing tank, a pipe from an outlet of said pump extending into said developing tank, whereby actuation of said pump exhausts replenishing solution into said developing tank.

6. The apparatus of claim 1 comprising a waste fluid tank removably located under said processing tanks and adapted to receive and store waste overflow from said processing tanks.

7. The apparatus of claim 6 wherein there are two said waste fluid tanks.

8. The apparatus of claim 7 wherein one of said waste fluid tanks is for overflow developing solution only and the other of said waste fluid tanks is for other overflow processing solutions.

9. The apparatus of claim 1 having a hinged door thereon, said replenishing tanks removably located on said door whereby opening said door exposes said replenishing tanks.

10. The apparatus of claim 1 further comprising at least one rail extending substantially horizontally and adapted to slide out of said apparatus, said replenishing tank mounted on said rail, whereby said replenishing tank can slide out of said apparatus on said rail.

11. The apparatus of claim 9 wherein there are two doors, hinged so as to meet between the hinges, whereby said replenishing tanks can be removed from said apparatus.

12. An apparatus for processing photosensitive material having a plurality of elements including processing tanks and a drying portion, said processing tanks comprising a developing tank; a bleaching tank and a fixing tank, or a bleach/fix tank; and a rinsing tank; there being a replenishing tank for each of said processing tanks on one side of said processing tanks, a waste fluid tank for receiving and storing waste fluid removably located under said processing tanks wherein said replenishing tank corresponding to said developing tank comprises a circulating means and at least one rail extending substantially horizontally and adapted to slide out of said apparatus, said replenishing tanks mounted on said rail, whereby said replenishing tanks can slide out of said apparatus on said rail.

13. An apparatus for processing photosensitive material having a plurality of processing tanks, a drying portion, a replenishing tank for said processing tanks beside said processing tanks, a waste fluid tank for receiving and storing waste fluid removably located under said processing tanks and a hinged door thereon, wherein said replenishing tanks are removably located on said door whereby opening said door exposes said replenishing tanks.

14. The apparatus of claim 13 wherein said processing tanks comprise a developing tank; a bleaching tank, a fixing tank, or a bleach/fix tank; and a rinsing tank.

15. An apparatus for processing photosensitive material having a plurality of processing tanks, a drying portion, a replenishing tank for said processing tanks beside said processing tanks, a waste fluid tank for receiving and storing waste fluid removably located under said processing tanks, wherein there are two doors, hinged so as to meet between the hinges, whereby said replenishing tanks can be removed from said apparatus.

16. The apparatus of claim 15 wherein said processing tanks comprise a developing tank; a bleaching tank, a fixing tank, or a bleach/fix tank; and a rinsing tank.

* * * * *